US012420325B2

(12) United States Patent
Hilton et al.

(10) Patent No.: US 12,420,325 B2
(45) Date of Patent: Sep. 23, 2025

(54) PRESS BRAKE SHEET FOLLOWER

(71) Applicant: ACCURPRESS AMERICA INC., Rapid City, SD (US)

(72) Inventors: Steve Hilton, Rapid City, SD (US); Don Wishard, Rapid City, SD (US)

(73) Assignee: ACCURPRESS AMERICA INC., Rapid City, SD (US)

( * ) Notice: Subject to any disclaimer, the term of this patent is extended or adjusted under 35 U.S.C. 154(b) by 256 days.

(21) Appl. No.: 18/132,682

(22) Filed: Apr. 10, 2023

(65) Prior Publication Data

US 2023/0321707 A1 Oct. 12, 2023

Related U.S. Application Data

(60) Provisional application No. 63/329,027, filed on Apr. 8, 2022.

(51) Int. Cl.
*B21D 5/02* (2006.01)

(52) U.S. Cl.
CPC ..... *B21D 5/0281* (2013.01)

(58) Field of Classification Search
CPC .... B21D 5/002; B21D 5/0281; B21D 43/003; B21D 43/02
See application file for complete search history.

(56) References Cited

U.S. PATENT DOCUMENTS

2017/0080469 A1* 3/2017 Badegruber ..... B21D 5/0281
2021/0086245 A1 3/2021 Guernsey et al.

FOREIGN PATENT DOCUMENTS

CN 210876878 U 6/2020
JP 05-154562 A * 6/1993 ..... B21D 5/02
JP 05-154562 A1 6/1993
JP 2021-045767 A 3/2021
WO 2012-019220 A1 2/2012

OTHER PUBLICATIONS

International Search Report and Written Opinion dated Jul. 25, 2023 issued by the International Searching Authority in the related International Patent Application No. PCT/US2023/018061; filed Apr. 10, 2023.

* cited by examiner

*Primary Examiner* — Debra M Sullivan
(74) *Attorney, Agent, or Firm* — Gordon Rees Scully Mansukhani LLP

(57) ABSTRACT

A press brake assembly with a sheet follower with an actuation assembly that allows the sheet follower to follow a downwards bending workpiece. The sheet follow is adjacent to the press brake and is capable of following the workpiece throughout different bends without changing the position of the workpiece. The sheet follower includes a table and rotatable arms attached to the table. The actuation assembly of the sheet follower includes two blocks that is configured to move the rotatable arms that allow the table to follow the bending of the workpiece.

16 Claims, 10 Drawing Sheets

PRESS BRAKE SHEET FOLLOWER

CROSS-REFERENCE TO RELATED APPLICATION

This application claims the benefit of U.S. Provisional Patent Application No. 63/329,027, filed Apr. 8, 2022, which is incorporated by reference herein in its entirety.

The present disclosure relates to a press brake system. In particular, a sheet follower assembly for a press brake.

The process of forming sheet metal typically incorporates the use of a metal forming press brake that includes two forming assemblies which are pressed against one another by the press brake. The press brake typically includes an upper ram assembly which includes a heavy metal ram, a punch holder that clamps and holds a punch that is driven down into a stable forming die mounted on a lower bed assembly. The bed assembly includes a clamping system to hold the lower die in place while metal forming is performed. The metal forming process creates a bend on the sheet metal that forms to the contour of the die. Since the punch and the die are affixed during the bending process, in order to make an opposite or reverse angled bend in the sheet metal, the press brake must be paused and the sheet metal workpiece must be turned over in order to allow the press brake to form the opposite or reverse bend. Pausing the press brake and moving the sheet metal workpiece is inefficient. Thus, a system for performing reverse bending without the requirement of turning the sheet metal workpiece is disclosed herein.

A sheet follower is also typically provided to aid in the forming the bend onto the sheet metal workpiece. The typical sheet follower includes a plate that provides support to the sheet metal workpiece while the bending process is executed. Current sheet followers cannot rotate below zero degrees relative to a horizontal plane (i.e., a plane parallel to the floor). However, with the introduction of the new method of reverse bending as discussed above, a larger rotation range for the sheet follower is required in order to support the workpiece during a reverse bend process. Conventional prior sheet followers cannot follow a reverse bend without changing the position of the workpiece. Furthermore, the workpiece bending process typically requires the operator to control the workpiece from the waist level to shoulder level. However, when the motion is reversed (i.e. reverse bend), the operator has to control the metal from at a lower point (e.g., waist to knee level), which is difficult.

As described herein, an improved sheet follower is provided in order to address the concerns discussed above.

BRIEF DESCRIPTION OF THE DRAWINGS

The features, aspects, and advantages of the disclosed press brake and tool system will become apparent from the following description, and the accompanying exemplary embodiments shown in the drawings, which are briefly described below.

DETAILED DESCRIPTION

Figure 1:
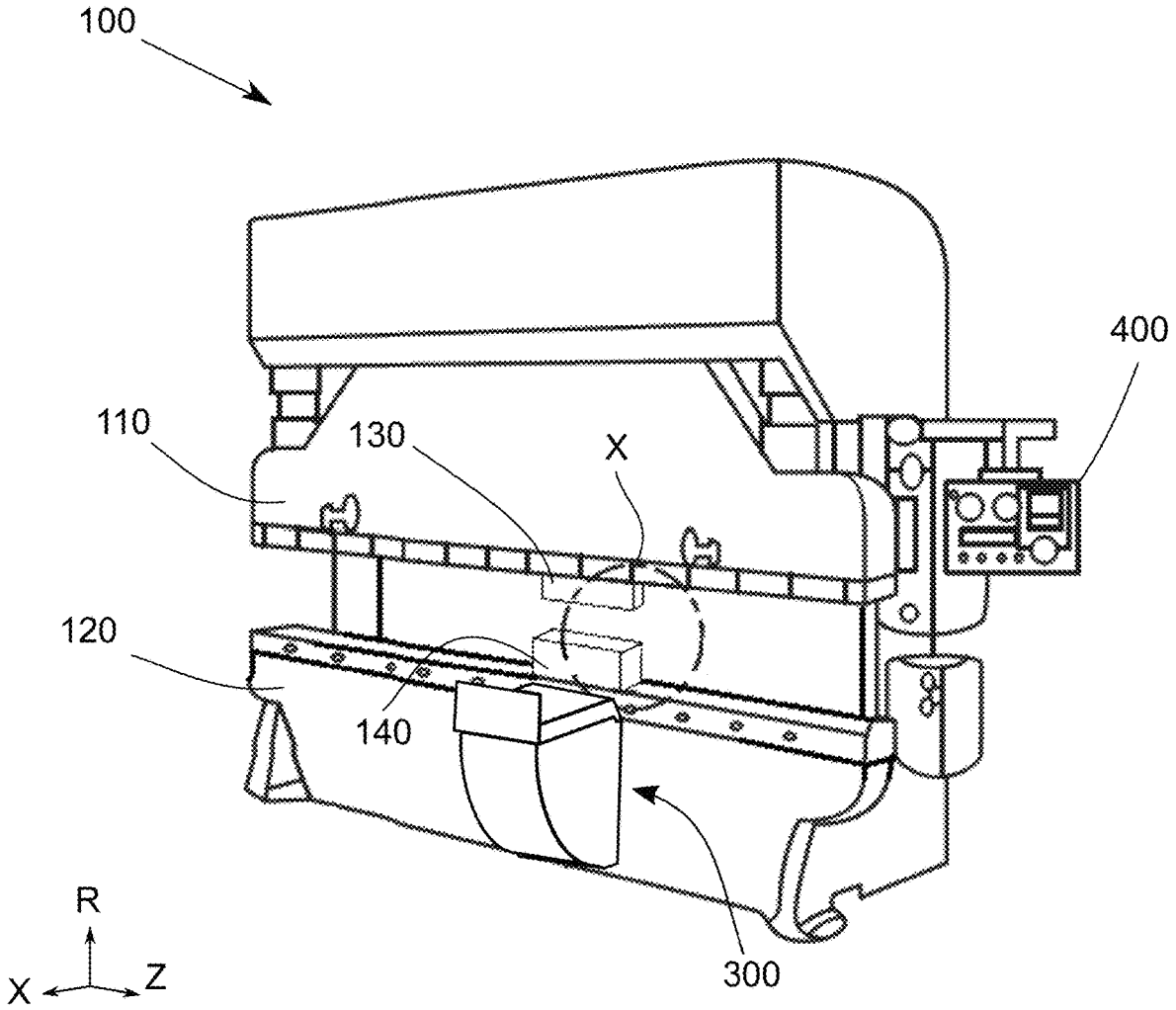
FIG. 1 is an isometric view of an exemplary press brake.

A press brake machine configured to bend a workpiece is disclosed herein. The press brake machine comprises an upper beam, a lower beam, wherein one of the upper beam and lower beam moves to reduce the distance between the upper beam and the lower beam in order to bend the workpiece. A sheet follower adjacent the lower beam, wherein the sheet follower is configured to remain in contact with the workpiece when the workpiece bends downwards.

In another embodiment, a press brake machine configured to bend a workpiece is disclosed herein. The press brake machine comprising an upper beam configured to hold an upper tool assembly configured to hold an upper tool comprising an upper punch or an upper die, a lower beam configured to hold a lower tool assembly configured to hold a lower tool comprising a lower punch or a lower die; and wherein one of the upper beam and lower beam moves to reduce the distance between the upper beam and the lower beam in order to bring the upper tool and the lower tool together in order to bend the workpiece a sheet follower adjacent the lower beam, wherein the sheet follower includes a plate configured to remain in contact with the workpiece when the workpiece bends at an angle below a horizontal plane, wherein the horizontal plane is parallel to a lower beam longitudinal axis.

In another embodiment, a sheet follower for a press brake machine configured for bending a workpiece is disclosed herein. The sheet follower comprises a plate assembly attached to the press brake assembly, a pivotable table having a plate configured to contact with the workpiece, a plurality of arms connecting the pivotable table to the plate assembly. The pivotable table is configured to follow the bend of the workpiece at an angle below a horizontal plane that is parallel to a floor of the press brake machine. A first block mounted on the plate assembly, a second block attached to at least one arm of the plurality of arms. The second block is configured to move closer or father apart relative to the first block in order to rotate the at least one arm. The movement of the second block moves the plurality of arms and allows the pivotable table to follow the bending of the workpiece.

The press brake machine described herein may be generally structured, for example, in the manner of the press brake machine disclosed in application Ser. No. 16/541,021, filed on Aug. 14, 2019 (incorporated by reference herein in its entirety). An exemplary press brake machine may include a ram located above a bed. The machine may include one or more hydraulic cylinders that force the ram (and a connected punch) downward toward the bed (and a connected die). Alternatively, the force of hydraulic pressure may be used to force the bed upward. The press brake machine processes a workpiece (e.g., sheet metal) by bending the workpiece to form a desired shape.

According to an embodiment disclosed herein, a press brake is configured to bend a workpiece includes an upper beam configured to hold an upper rotary tool. The upper rotary tool includes an upper punch and an upper die. The press brake includes a lower beam configured to hold a lower rotary tool, wherein the lower rotary tool includes a lower punch and a lower die. The upper rotary tool is configured to rotate between two positions wherein one or the other of the upper punch and the upper die is positioned to make contact with the workpiece. The lower rotary tool is configured to rotate between two positions wherein one or the other of the lower punch and the lower die is positioned to make contact with the workpiece. The upper rotary tool is configured to position the upper punch downwards when the lower rotary tool positions the lower die upwards so that the upper punch and the lower die are configured to bend the workpiece when one of the upper beam and lower beam is moved in a direction towards the workpiece. The rotary tool and press brake machine may be structured as disclosed in U.S. patent application Ser. No. 17/458,011 filed Aug. 26, 2021, which is incorporated by reference herein in its entirety.

FIG. 1 shows an exemplary press brake machine 100. The press brake machine is used to bend or otherwise deform sheet-like workpieces, such as sheet metal workpieces (not shown). The press brake machine may include a controller 400 configured to operate the press brake either manually or autonomously. The controller 400 may also be used to control the movement of the workpiece and any tools associated with the press brake machine. Additional parts such as tooling systems, gauges, and measurements systems disclosed in U.S. patent application Ser. Nos. 15/814,158, 16/180,983, 16/541,060, 16/541,021, and 16/578,188 (all incorporated by reference herein in its entirety) may be utilized be the press brake machine 100. The press brake machine 100 has an upper beam or ram 110 and a lower beam or bed 120, at least one of which is movable toward and away from the other. Preferably, the upper beam is movable vertically while the lower beam is fixed in a stationary position. Although generally fixed, the position of the lower beam may be adjusted through use of a crowning system to ensure consistent bending of longer workpieces. The press brake machine 100 of FIG. 1 is an exemplary machine, and the rotary tools described herein can be employed with such a press brake machine or other conventional press brake machine. A sheet follower 300 may be attached at the side of the bed 120 or at a predetermined distance from the bed 120. The sheet follower 300 is configured to follow the displacement of the sheet during the bending process in order to provide support to the sheet.

As shown in FIG. 1, the Z-axis is parallel to and follows the length of the bed. The X-axis is parallel to and follows the width of the bed. The R-axis extends upwards and downwards. The R-axis is parallel to and follows the height of the bed. The Z-axis, X-axis, and R-axis are perpendicular relative to each other.

Figure 2:
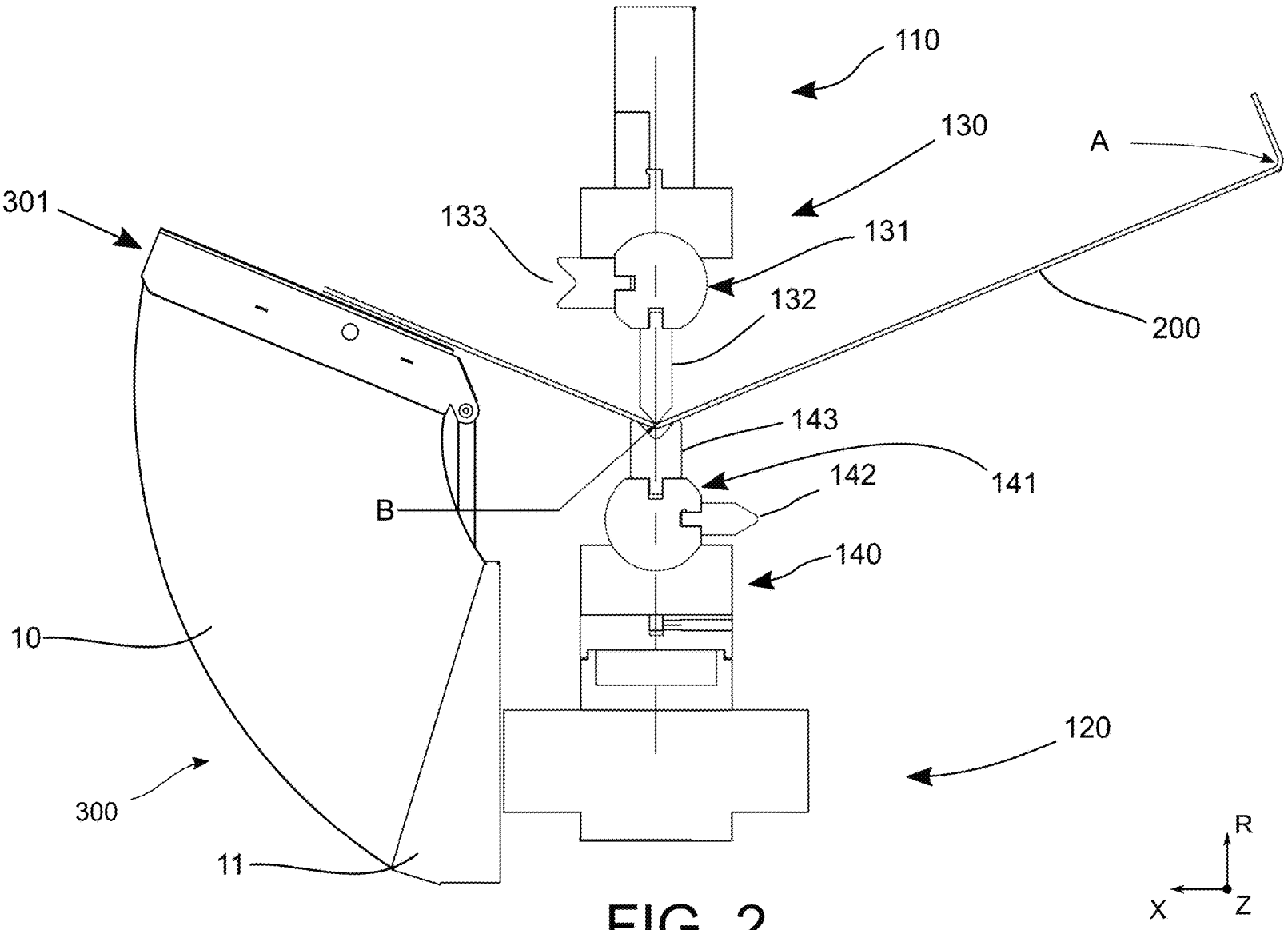
FIG. 2 is a side view of a press brake including a rotary tool assembly in a first position.

FIG. 2 is an isolated sectioned close up 'X', as labeled in FIG. 1, of the upper beam 110 with the upper tool assembly 130, lower tool assembly 140, lower beam 120, and a workpiece 200 with a first bend "A" and second bend "B". The upper tool assembly 130 includes an upper rotary tool 131 that holds an upper punch 132 and an upper die 133. Similarly, the lower tool assembly 140 includes a lower rotary tool 141 that holds a lower punch 142 and a lower die 143. In the configuration shown in FIG. 2, the upper punch 132 projects downward into the lower die 143 in order to create the second bend "B". Workpiece 200 is disposed above the lower die 143 and below the upper punch 132. The upper punch 132 includes a workpiece deforming surface at the tip. The configuration of the deforming surface is dictated by the shape into which the workpiece 200 is to be deformed. The shape of the workpiece is also dependent on the shape of the lower die 143, which can utilize different shapes. When the upper and lower beams 110/120 are brought together, the workpiece 200 located between them is pressed by the punch into the die to give the workpiece a desired deformation (e.g., a desired bend). The sheet follower 300 may include bellows 10 extending from the bottom of table 301 to the bellows cover 11. The bellows 10 functions as a shroud to enclose the moving components of the sheet follower. The sheet follower follows the bend of the workpiece 200 to support the workpiece during and after the bending process. As shown in FIG. 2 the sheet follower table or plate 301 rotates upward as the press brake 100 creates bend "B".

Figure 3:
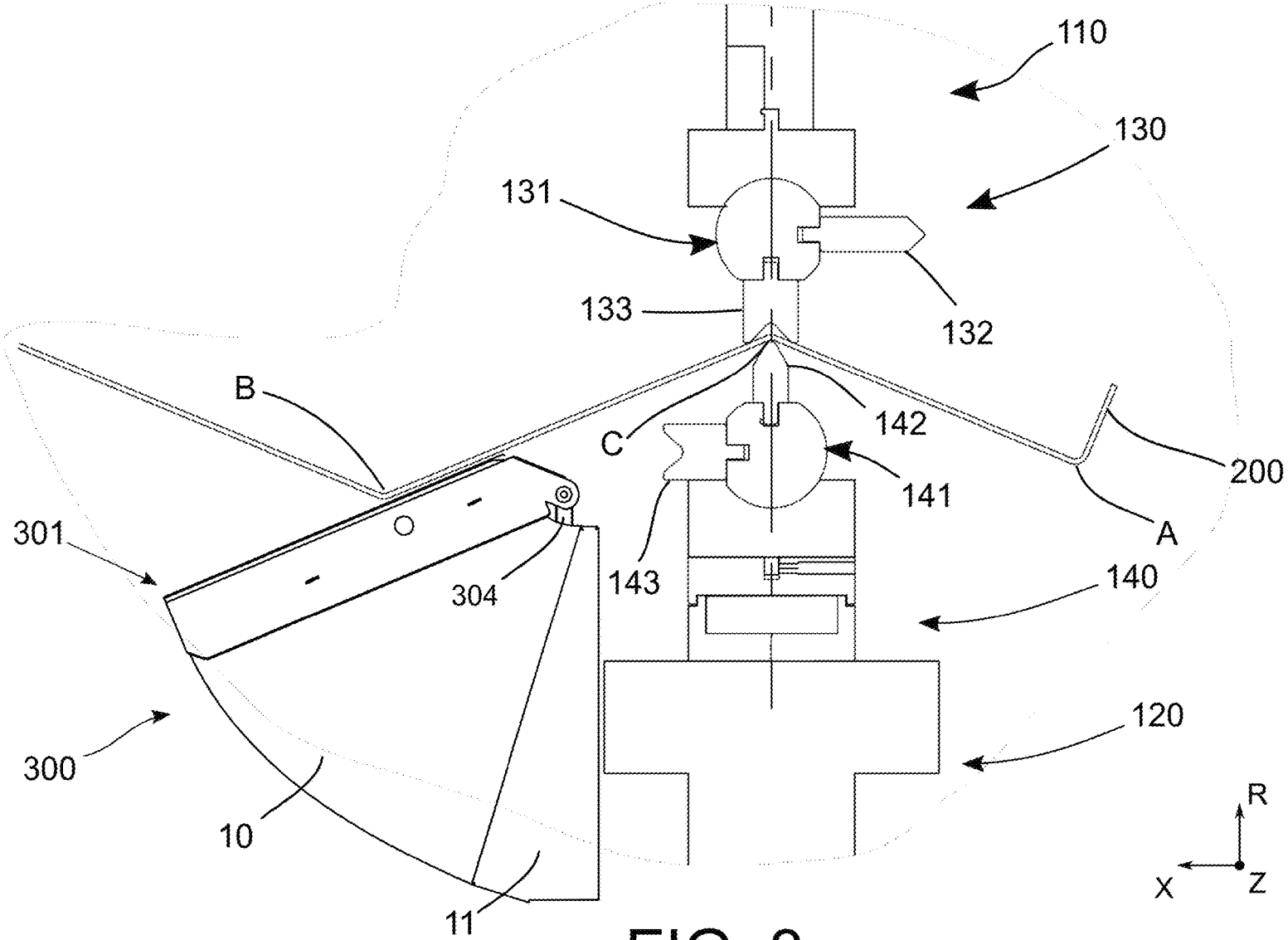
FIG. 3 is a side view of the press brake shown in FIG. 2 with the rotary tool assembly in a second position.

Both rotary tools 131 and 141 may be configured to rotate in order to create different bends. For example, upper rotary tools 131 may rotate so that the upper die 133 is facing the workpiece 200 while the lower rotary tools 141 rotates so that the lower punch 143 is facing the workpiece 200. FIG. 3 shows the rotated positions of the rotary tools 131, 141. In FIG. 3, the press brake assembly may be arranged so that the upper and lower rotary tools are positioned so that upper die 133 and lower punch 142 are in place to bend the workpiece with a downward bend "C". In the position shown in FIG. 3, the lower beam 120 may be configured to move upwards rather than having the upper beam 110 move downwards, or both the lower beam or upper beam may be configured to move in order to make the reverse bend "C". The sheet follower follows the bend of the workpiece 200 to support the workpiece during and after the bending process. As shown in FIG. 3, the sheet follower table 301 rotates downward as the press brake 100 creates the reverse bend "C".

Figure 4:
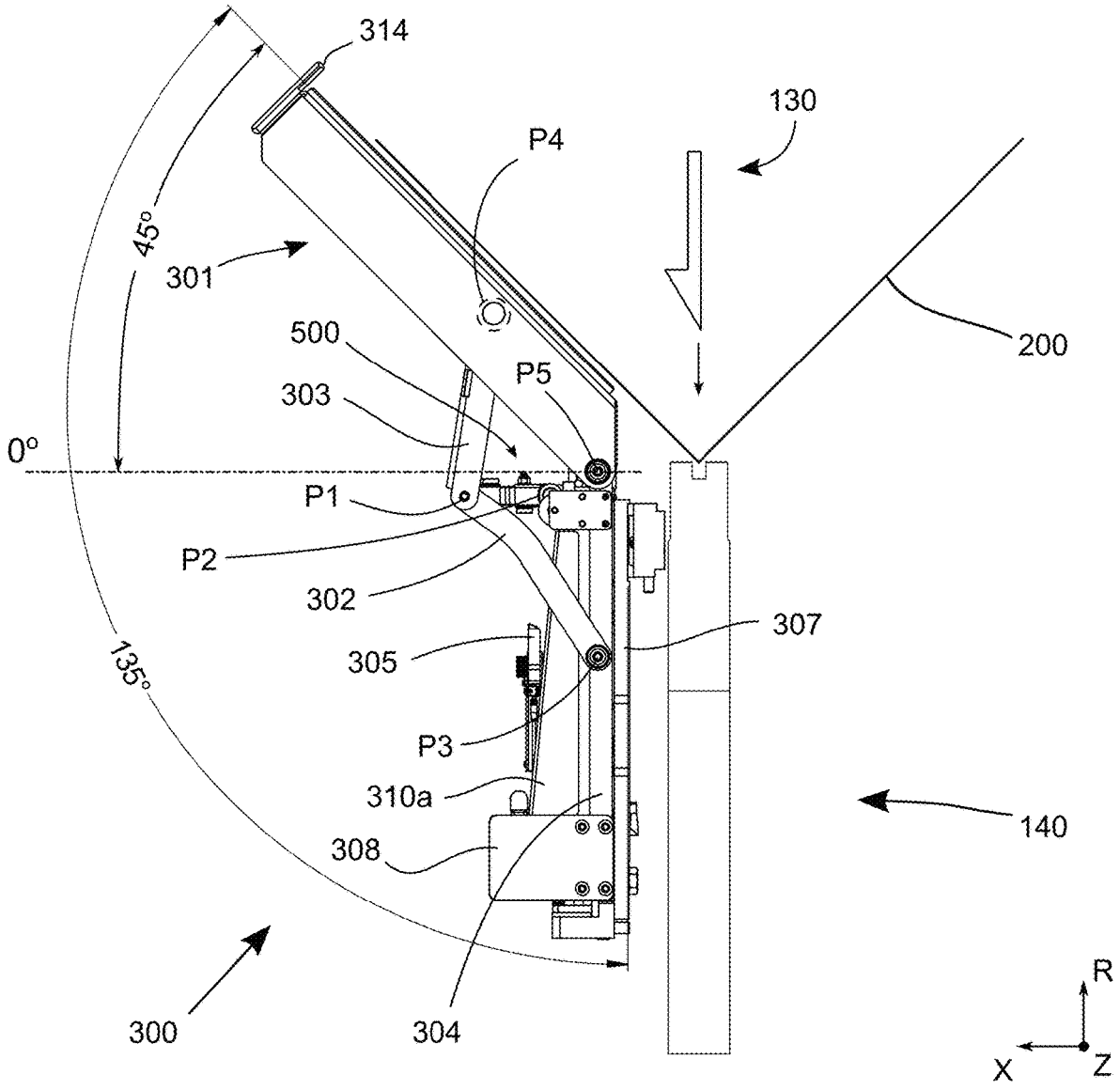
FIG. 4 is a side view of the press brake shown in FIG. 2 with a detailed view of the sheet follower during a bend.
Figure 5:
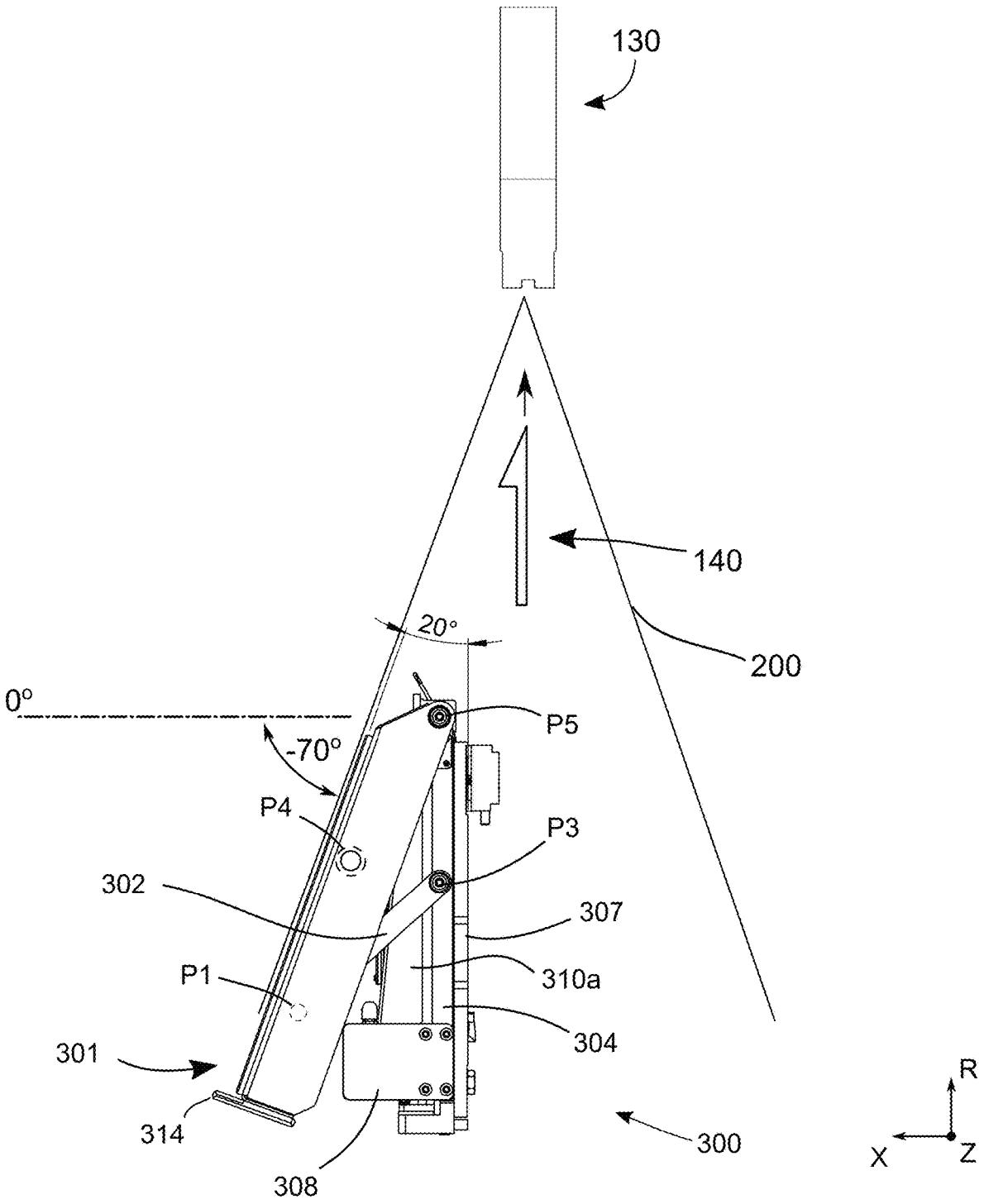
FIG. 5 is a side view of the press brake shown in FIG. 3 with a detailed view of the sheet follower during a reverse bend.

FIGS. 4 and 5 are side views of the sheet follower 300 of the press brake 100. FIG. 4 depicts the sheet follower in a position similar to the position shown in FIG. 2, in which the sheet follower 300 follows the bend of the workpiece upwards in the R-axis. FIG. 5 depicts the sheet follower in a position similar to the shown in FIG. 3, in which the sheet follower follows the bend of the workpiece downwards in the R-axis. The sheet follower includes a table or plate 301, a pair of horizontal levers 302, a pair of vertical levers 303, a back plate 304, and a block and tackle assembly 500. The horizontal lever 302 is configured to be pivotably connected to the back plate 304 and the vertical lever 303. The vertical lever 303 is pivotably connected to the horizontal lever 302 and the table 301. A first pivot P1 is created between the vertical lever 303 and the horizontal lever 302. The block and tackle assembly 500 is configured to be pivotably connected to the vertical lever 303 and horizontal lever 302 at the first pivot P1. The block and tackle assembly 500 further includes a block pivot P2. The block pivot P2 allows the block and tackle assembly 500 to pivot at the block pivot P2 in addition to the first pivot point P1. A third pivot P3 is created from the connection of the horizontal lever to the back plate 304. A fourth pivot P4 is created from the connection of the vertical arm 303 to the table 301. A fifth pivot P5 is created from the connection co4nection of the table 301 to the back plate 304. The back plate 304 is also configured to move up and down. This configuration allows the sheet follower to follow the bend of the workpiece 200 and support the workpiece during bends. FIG. 4 shows the sheet follower 300 at a max angle of 45° relative to the XZ-plane (or 135° relative to the ZR-axis). FIG. 5 shows the sheet follower 300 at a downward angle of minus (–) 70° relative to the XZ-plane (or 20° relative to the ZR-plane).

Each pivot P1-P4 may be a rotational axis parallel to the Z-axis. The upper surface of table 301 may utilize a high abrasion and wear resistance material such as ultra high molecular weight polyethylene (UHMW plastic). The table 301 may also include a stop plate 314 for additional support during bending. The pivots may utilize roller bearings but other known pivot mechanisms may be utilized.

The block and tackle assembly 500 is configured to provide rotational movement to the table by rotating the horizontal levers 302 via the third pivot P3 at the connection between the horizontal levers 302 and the back plate 304.

A first motor 308 is provided to actuate a belt (not shown) of the block and tackle assembly 500. The first motor 308 is configured to winch or un-winch the belt 310 of the block and tackle assembly. The belt 310 is configured to wind across the block and tackle assembly to allow the motor 308 to control the rotation of the table 301.

Locking shoulders 305 are configured to hold the horizontal levers 302 when the sheet is between 0° and 45° (inclusive) as shown in FIG. 4. The locking shoulders are configured to ease the load from the motor 308 when the sheet follower is not moving (i.e. in a static position). This ensures the longevity of the first motor 308. The locking shoulders 305 may be controlled via a linear actuator (not shown).

A mounting plate 307 may be provided to mount the sheet follower 302 to a press brake structure such as the lower tool assembly 140.

The table 301 is configured to support the workpiece throughout the process shown in FIGS. 2 and 3 and any position intermediate from FIG. 2 to FIG. 3.

Figure 6:
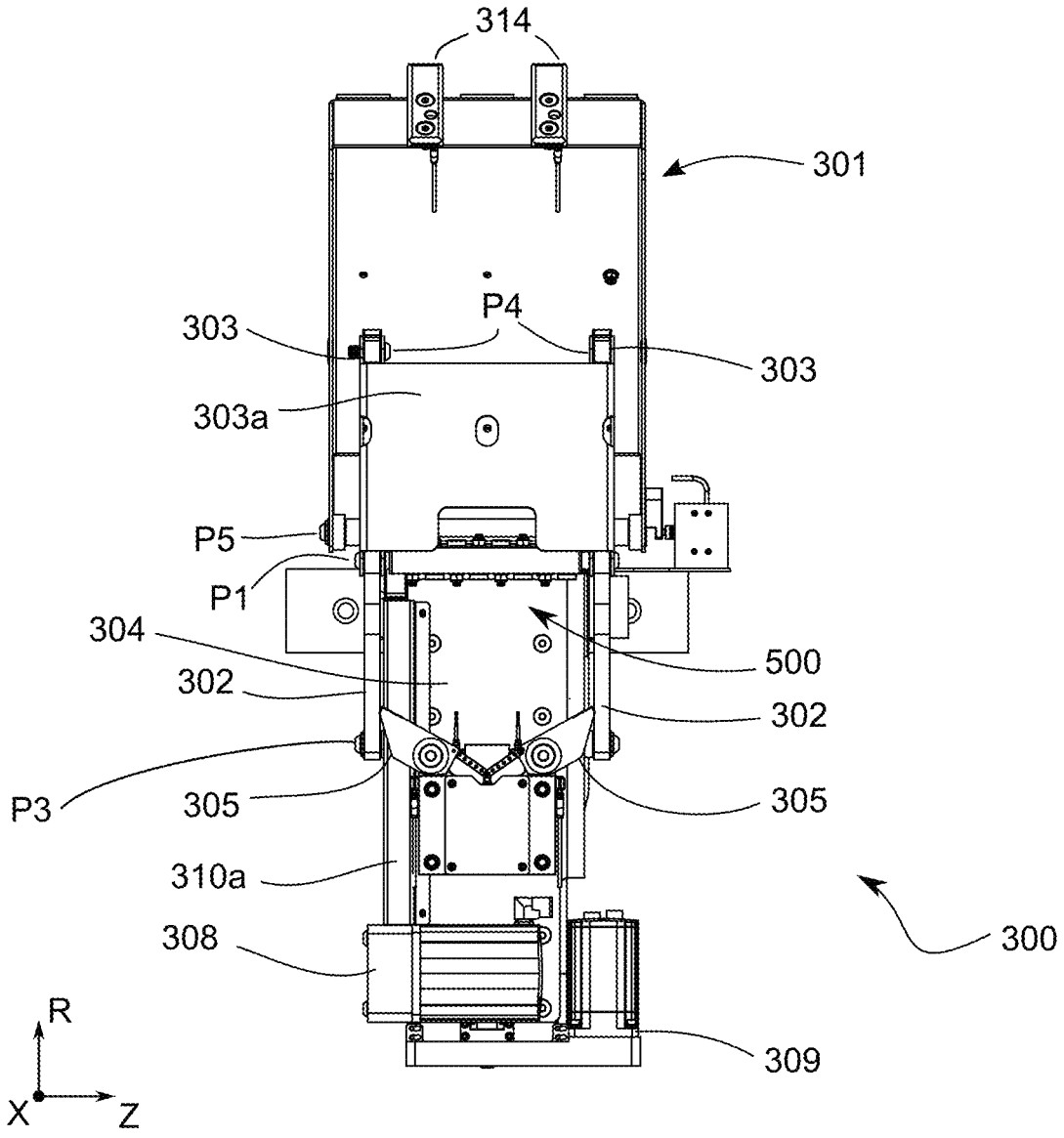
FIG. 6 is a front view of an exemplary sheet follower.

FIG. 6 shows a front view of the sheet follower 300 with the table 301 at a maximum upper angle configuration as shown in FIG. 4. A second motor 309 may also be provided for the sheet follower 300. The second motor 309 may operate to control the height of the table 301 relative to the R-axis. The second motor is configured to accommodate for the offset between the rotation axis and the bending in the X-axis. The second motor 309 may be configured to control the height of the back plate 304 via a belt and gear system. The second motor 309 may be configured to turn a ball screw (not shown) that is configured to linearly actuate the black plate 304. The vertical links 303 may include a vertical link plate 303*a* that is connected to both vertical links 303.

Figure 7A:
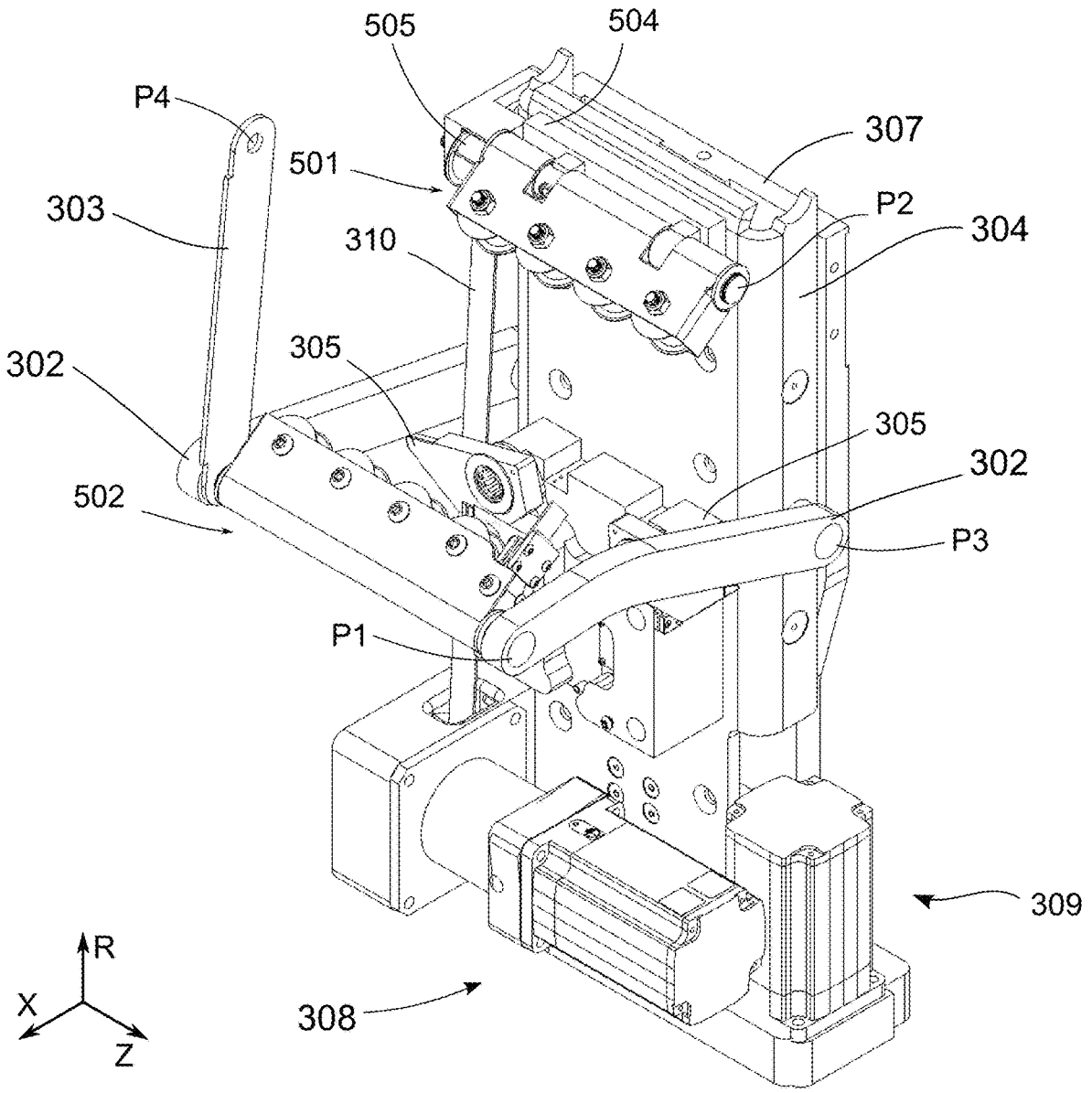
FIG. 7*a* is an isometric view of an exemplary sheet follower.
Figure 7B:
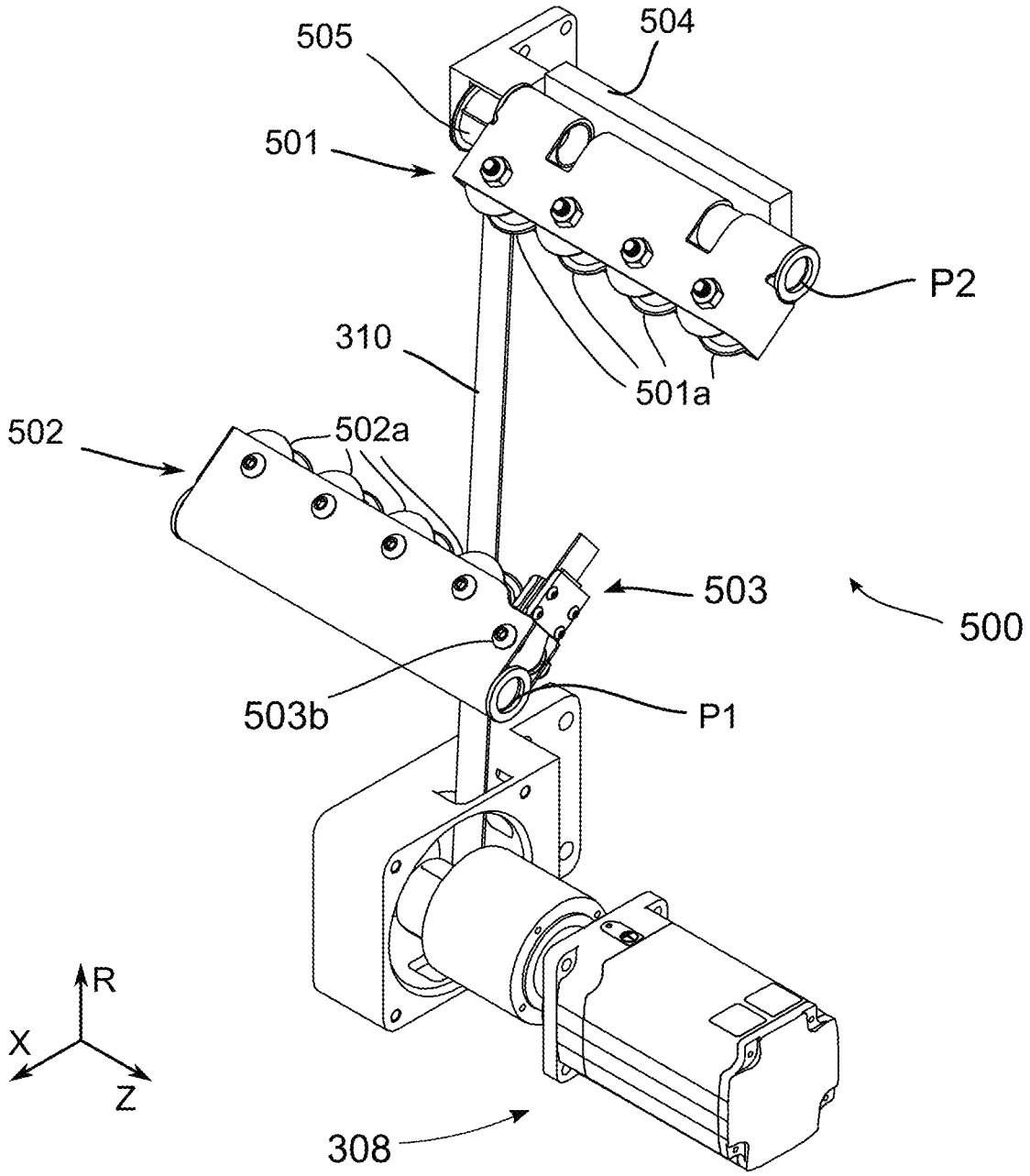
FIG. 7*b* is an isometric view of a block and tackle assembly of an exemplary sheet follower.

FIG. 7*a* shows the sheet follower assembly 300 with elements omitted such as the table 301, one lever of the vertical levers 303, and belt cover 310*a*. FIG. 7*b* shows the block and tackle assembly 500 with additional components removed from FIG. 7*a*. The belt and tackle assembly 500 includes a first block 501 and a second block 502. The first block 501 is attached to a mounting block that is configured to be attached to the black plate 304. The belt and tackle assembly 500 further includes a belt 310 attached to the motor 308 at a first end and a belt clamp 503 at a second end. Intermediate to the first and second end, the belt 310 is winded in an alternating pattern between the idler pulleys 501*a* and 502*a* of the first and second blocks 501/502. A feed idler pulley 505 may be utilized to feed the belt from the motor to the second block 502.

Figure 8:
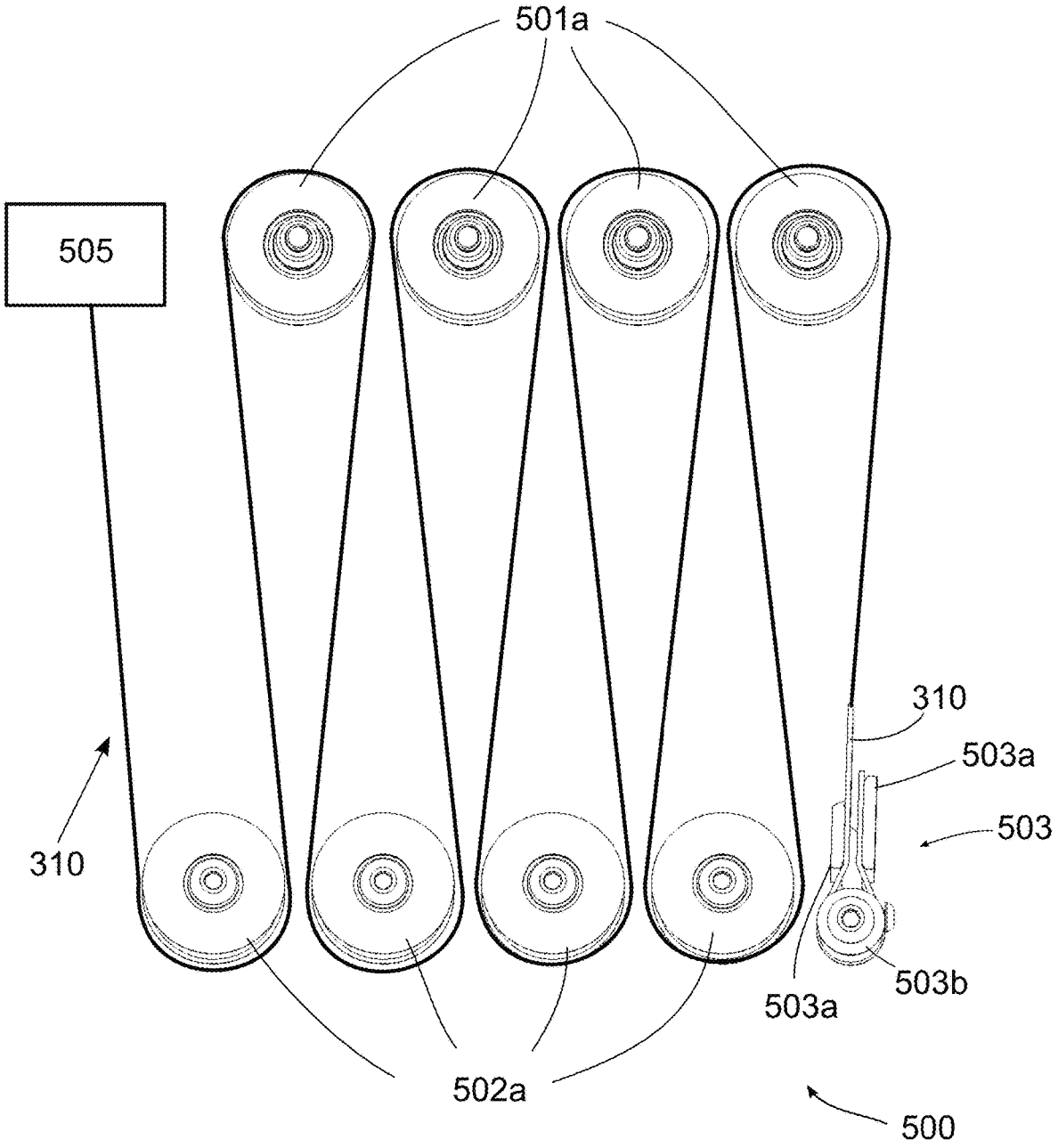
FIG. 8 is a simplified diagram of a block and tackle assembly of an exemplary sheet follower.

FIG. 8 shows a simplified diagram of the block and tackle assembly 500 with the belt 310 arranged in an exemplary loop configuration. The belt 310 ends at the belt clamp 503. Belt clamp 503 may include belt clamp plates 503*a* configured to be fastened together to hold the second end of the belt 310. The belt 310 may be looped around a belt clamp rod 503*b*. The belt 310 may be internally reinforced in order to provide additional strength and durability. For example, belt 310 may be a nylon belt reinforced internally with steel rope. Other configurations of the block and tackle assembly 500 may be utilized, such as the number of pulleys/loops and/or where the belt clamp 503 is located at the first block 501 instead of the second block 502. Other systems such as a gearbox may also be utilized in place of the block and tackle assembly 500. The gearbox may be designed such that the movement of the table 301 is identical to the movement of the table 301 utilizing the block and tackle assembly 500.

Figure 9:
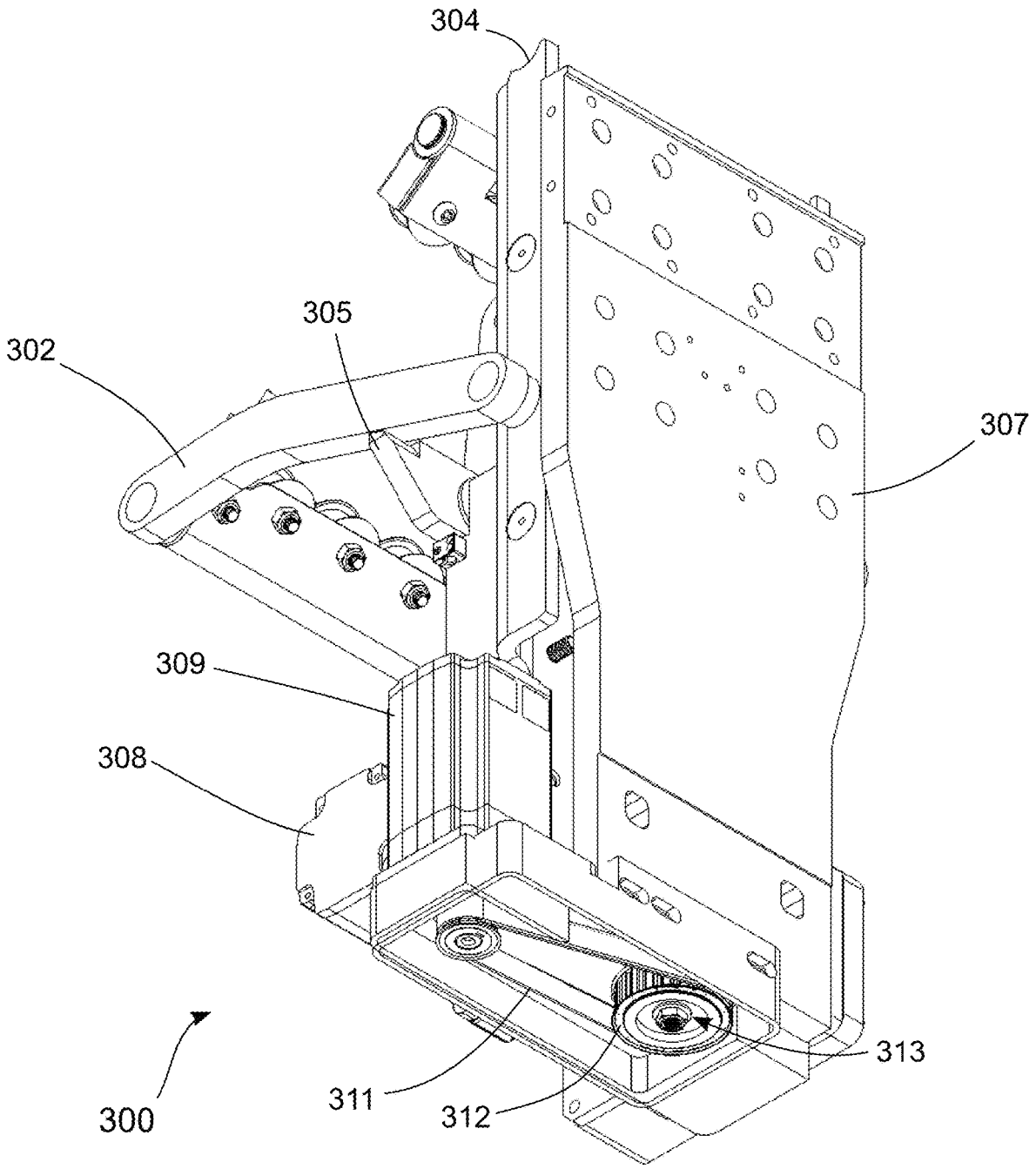
FIG. 9 is a rear bottom view of an exemplary sheet follower.

FIG. 9 shows the mechanism for controlling and adjusting the height of the back plate in the R-axis. The second motor 309 may rotate an auxiliary belt 311 which rotates an auxiliary pulley 312. The pulley rotates a ball screw assembly 313 which is connected to the back plate 304. The ball screw assembly 313 is configured to move linearly to adjust the height of back plate 304. A third motor may be utilized (not shown) in order to move the sheet follower assembly 300 across the Z-axis along the length of the bed.

Other rotating mechanisms for the sheet follower table may be employed instead of the block and tackle system described herein. For example, a gear mechanism may be employed. Although the sheet follower 300 described herein is attached to a rotary tool press brake capable of reverse bend press brake, the disclosed sheet follower may be utilized in a typical press brake that does not include a rotary tool and does not provide the capability of the reverse bend (without removing and repositioning the workpiece). The sheet follower may follow the workpiece downwards in scenarios where parts of the workpiece rotates downwards during a typical press brake bending.

In sum, an improved press brake system for efficient workpiece bending is disclosed herein.

As utilized herein, the terms "approximately," "about," "substantially", and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the disclosure as recited in the appended claims.

It should be noted that the term "exemplary" as used herein to describe various embodiments is intended to indicate that such embodiments are possible examples, representations, and/or illustrations of possible embodiments (and such term is not intended to connote that such embodiments are necessarily extraordinary or superlative examples).

The terms "coupled," "connected," and the like as used herein mean the joining of two members directly or indirectly to one another. Such joining may be stationary (e.g., permanent) or moveable (e.g., removable or releasable). Such joining may be achieved with the two members or the two members and any additional intermediate members being integrally formed as a single unitary body with one another or with the two members or the two members and any additional intermediate members being attached to one another.

References herein to the positions of elements (e.g., "top," "bottom," "above," "below," etc.) are merely used to describe the orientation of various elements in the FIGURES. It should be noted that the orientation of various elements may differ according to other exemplary embodiments, and that such variations are intended to be encompassed by the present disclosure.

It is important to note that the press brake sheet follower as shown in the various exemplary embodiments is illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. For example, elements shown as integrally formed may be constructed of multiple parts or elements, the position of elements may be reversed or otherwise varied, and the nature or number of discrete elements or positions may be altered or varied. The order or sequence of any process or method steps may be varied or re-sequenced according to alternative embodiments. Other substitutions, modifications, changes and omissions may also be made in the design, operating conditions and arrangement of the various exemplary embodiments without departing from the scope of the present disclosure.

What is claimed is:

1. A press brake machine configured to bend a workpiece comprising:

an upper beam;

a lower beam;

wherein one of the upper beam and the lower beam moves to reduce a distance between the upper beam and the lower beam in order to bend the workpiece;

a sheet follower adjacent to lower beam, wherein the sheet follower is configured to remain in contact with the workpiece when the workpiece bends downwards;

a plate assembly attached to the lower beam;

a pivotable table having a plate configured to contact with the workpiece;

a plurality of arms connecting the pivotable table to the plate assembly;

wherein the pivotable table is configured to follow the bend of the workpiece at an angle below a horizontal plane that is parallel to a flow of the press brake machine;

an actuation assembly attached to at least one arm of the plurality of arms, wherein the actuation assembly is configured to rotate the pivotable table in order to follow the bend of the workpiece;

wherein the actuation assembly comprises a first block mounted on the plate assembly;

a second block attached to the at least one arm; and wherein the second block is configured to move closer or father apart relative to the first block in order to rotate the at least one arm.

2. The press brake machine of claim 1, wherein the sheet follower is parallel to the workpiece when the workpiece bends downwards.

3. The press brake machine of claim 1, wherein the plate is configured to move to follow the bend of the workpiece downwards at an angle between 0° and 70° relative to a horizontal plane.

4. The press brake machine of claim 1, wherein the sheet follower further comprises a first motor configured to control the actuation assembly in order to rotate the pivotable table.

5. The press brake machine of claim 4, wherein the sheet follower further comprises a second motor configured to control the height of the pivotable table.

6. A press brake machine configured to bend a workpiece comprising:

an upper beam configured to hold an upper tool assembly configured to hold an upper tool comprising an upper punch or an upper die;

a lower beam configured to hold a lower tool assembly configured to hold a lower tool comprising a lower punch or a lower die;

wherein one of the upper beam and lower beam moves to reduce a distance between the upper beam and the lower beam in order to bring the upper tool and the lower tool together in order to bend the workpiece;

a sheet follower adjacent the lower beam, wherein the sheet follower includes a plate configured to remain in contact with the workpiece when the workpiece bends at an angle below a horizontal plane, wherein the horizontal plane is parallel to a lower beam longitudinal axis;

a plate assembly attached to the lower beam;

a pivotable table having a plate configured to contact with the workpiece;

a plurality of arms connecting the pivotable table to the plate assembly;

wherein the pivotable table is configured to follow the bend of the workpiece at an angle below a horizontal plane that is parallel to a floor of the press brake machine;

an actuation assembly attached to at least one arm of the plurality of arms, wherein the actuation assembly is configured to rotate the pivotable table in order to follow the bend of the workpiece;

wherein the actuation assembly comprises a first block mounted on the plate assembly;

a second block attached to the at least one arm; and wherein the second block is configured to move closer or father apart relative to the first block in order to rotate the at least one arm.

7. The press brake machine of claim 6, wherein the plate is configured to move to follow the bend of the workpiece at an angle of 70° below the horizontal plane.

8. The press brake machine of claim 6, wherein the sheet follower further comprises a first motor configured to control the actuation assembly in order to rotate the pivotable table.

9. The press brake machine of claim 8, wherein the sheet follower further comprises a second motor configured to control the height of the pivotable table to allow the pivotable table to follow the workpiece.

10. A sheet follower for a press brake machine configured for bending a workpiece, wherein the sheet follower comprises:

a plate assembly attached to the press brake machine;

a pivotable table having a plate configured to contact with the workpiece;

a plurality of arms connecting the pivotable table to the plate assembly;

wherein the pivotable table is configured to follow the bend of the workpiece at an angle below a horizontal plane that is parallel to a floor of the press brake machine;

a first block mounted on the plate assembly;

a second block attached to at least one arm of the plurality of arms; and wherein the second block is configured to move closer or father apart relative to the first block in order to rotate the at least one arm;

wherein the movement of the second block moves the plurality of arms and allows the pivotable table to follow the bending of the workpiece.

11. The sheet follower of claim 10, wherein the sheet follower further comprises a first motor configured to control the actuation assembly in order to rotate the pivotable table.

12. The sheet follower of claim 11, wherein the sheet follower further comprises a second motor configured to control the height of the pivotable table to allow the pivotable table to follow the workpiece.

13. The sheet follower of claim 11, wherein the sheet follower further includes locking shoulders configured to hold the plurality of arms to ease loads away from the first motor when the sheet follower is in a static position.

14. The sheet follower of claim 10, wherein the sheet follower further includes a belt interleaved between pulleys of the first and second block.

15. The sheet follower of claim 14, wherein the belt is reeled by a first motor in order to control the plurality of arms.

16. The sheet follower of claim 10, wherein the second block and the plurality of arms share a common pivot point.

* * * * *